United States Patent [19]

van de Kerkhof

[11] Patent Number: 4,932,895

[45] Date of Patent: Jun. 12, 1990

[54] ELECTRICAL CONNECTORS

[75] Inventor: Lodevicus L. J. van de Kerkhof, Cr 's-Hertogenbosch, Netherlands

[73] Assignee: AMP Incorporated, Harrisburg, Pa.

[21] Appl. No.: 412,690

[22] Filed: Sep. 26, 1989

[30] Foreign Application Priority Data

Oct. 12, 1988 [GB] United Kingdom ..... 8823946

[51] Int. Cl.[5] ..... H01R 4/24

[52] U.S. Cl. ..... 439/417; 439/492

[58] Field of Search ..... 439/389–426, 439/492–499

[56] References Cited

U.S. PATENT DOCUMENTS

| | | | |
|---|---|---|---|
| 3,434,093 | 3/1969 | Wedekind | 339/17 |
| 4,753,608 | 6/1988 | Yamaguchi | 439/417 |
| 4,854,892 | 8/1989 | Vignoli | 439/417 |

FOREIGN PATENT DOCUMENTS 2134422 8/1984 United Kingdom .

OTHER PUBLICATIONS

European Patent Office Standard Search Report, 8-1-1-89.

*Primary Examiner*—Joseph H. McGlynn
*Attorney, Agent, or Firm*—Bruce J. Wolstoncroft

[57] ABSTRACT

An electrical connector (18) for terminating to a ribbon cable (2) or the like has a terminal housing member (20) and a cover member (22). A termination surface (36) is provided on the cover member (22) to cooperate with the ribbon cable (2) to accurately align the ribbon cable with the electrical connector (18). A first side wall (48) of the cover member (22) extends beyond the termination surface (36), to provide a stop surface (46) with which the ribbon cable (2) cooperates to insure that the ribbon cable is properly positioned. A movable portion (52) is provided on the stop surface (46), the movable portion (52) being movable relative to the stop surface (46). The movable portion (52) is bent outward, away from the ribbon cable (2), as the cable (2) is moved into engagement with the stop surface (46). This bending of the movable portion (52) allows the movable portion (52) to engage a proximity switch of application tooling, thereby terminating the connector (18) to the cable (2). The stop surface (46) provides a protective wall, preventing the conductors (4) of the cable (2) from being damaged during assembly and use of the connector.

5 Claims, 3 Drawing Sheets

ELECTRICAL CONNECTORS

FIELD OF THE INVENTION

The invention is directed to an electrical connector for use with ribbon cable or the like. In particular, the electrical connector has a wall which extends across the end of an opening into which the ribbon cable is inserted, thereby protecting the individual conductors from unwanted contact. A portion of the wall is movable to allow for the termination of the connector to the cable.

BACKGROUND OF THE INVENTION

Electrical connectors which make electrical connection to the end of a ribbon cable are well known. Generally these connectors have insulation piercing terminals which are placed in electrical engagement with the conductors of the cable. In order to properly terminate the cable to the connector, applicator tooling must be used.

In the applicator tooling, the connector is maintained in precise alignment. The ribbon cable is then inserted over the terminals of the connector through an opening or slot provided in the connector. The insertion of the ribbon cable continues until an end of the cable engages a switch in the applicator tooling, which causes the terminals to move toward the cable, thereby terminating the connector to the cable. The proper positioning of the switch insures that the cable and the connector are accurately aligned with respect to each other as termination occurs.

This method of termination insures that a proper termination is performed for each connector. However, as stated, for termination to occur, it is essential that the cable engage the switch when the cable is fully inserted into the slot or opening of the connector. Consequently, the end of the slot or opening must remain open in order for the end of the cable to engage the switch. This results in the ends of the conductors of the cable being exposed when the connector is terminated to the cable.

As the connector, cable assembly is handled and installed onto circuitry or the like, there is a possibility that the conductors will be engaged by an outside object, causing damage thereto. Therefore, exposing the ends of the conductors reduces the reliability of the connector assembly.

Consequently, in order to enhance the reliability of the connectors, covers are attached to the connectors after the termination of the connector to the cable has occurred. These covers extend over the exposed ends of the conductors, to prevent the conductors from being contacted during the handling and installation of the connectors. However, although these covers increase the reliability of the connector assembly, the cost of the connectors is increased due to the additional part required. It is important to note, that the covers can not be installed prior to insertion of the cable, because the covers would prevent the end of the cable from engaging the switch of the applicator tooling which triggers the termination.

Therefore, it would prove beneficial to provide a connector which has integral cover to protect the ends of the conductors of the cable. This would reduce the cost of manufacture of the connector, as fewer parts are required. However, it is essential that this connector be usable with the applicator tooling currently used for connectors of this type. Consequently, a means must be provided in the cover to activate the switch of the applicator tooling, so that the termination of the connector to the cable can occur in generally the same manner previously described.

SUMMARY OF THE INVENTION

The invention is directed to an electrical connector which is used to terminate a ribbon cable or the like. The electrical connector has a mating surface and a termination surface. The termination surface has terminals which extend therefrom, such that as the electrical connector is terminated to the ribbon cable, the terminals engage conductors of the ribbon cable to place the conductors and the terminals in electrical engagement. End walls and sidewalls of the connector extend from the mating surface to the termination surface.

The electrical connector is characterized in that a first side wall of the electrical connector extends beyond the termination surface, away from the mating surface, to provide a stop surface. The stop surface cooperates with an end of the ribbon cable as the ribbon cable is moved over the electrical connector. The engagement of the end of the cable with the stop surface insures that the ribbon cable is provided in accurate alignment with the electrical connector.

A movable portion is provided on the portion of the first side wall which extends beyond the termination surface. The movable portion is movable with respect to the stop surface. A projection is provided on the movable portion, and extends from the first side wall toward a second side wall. The projection cooperates with the ribbon cable as the ribbon cable is advanced toward the first end wall, such that as an end of the cable is positioned against the stop surface, the movable portion is caused to move away from the second side wall.

DETAILED DESCRIPTION OF THE INVENTION

Figure 1:
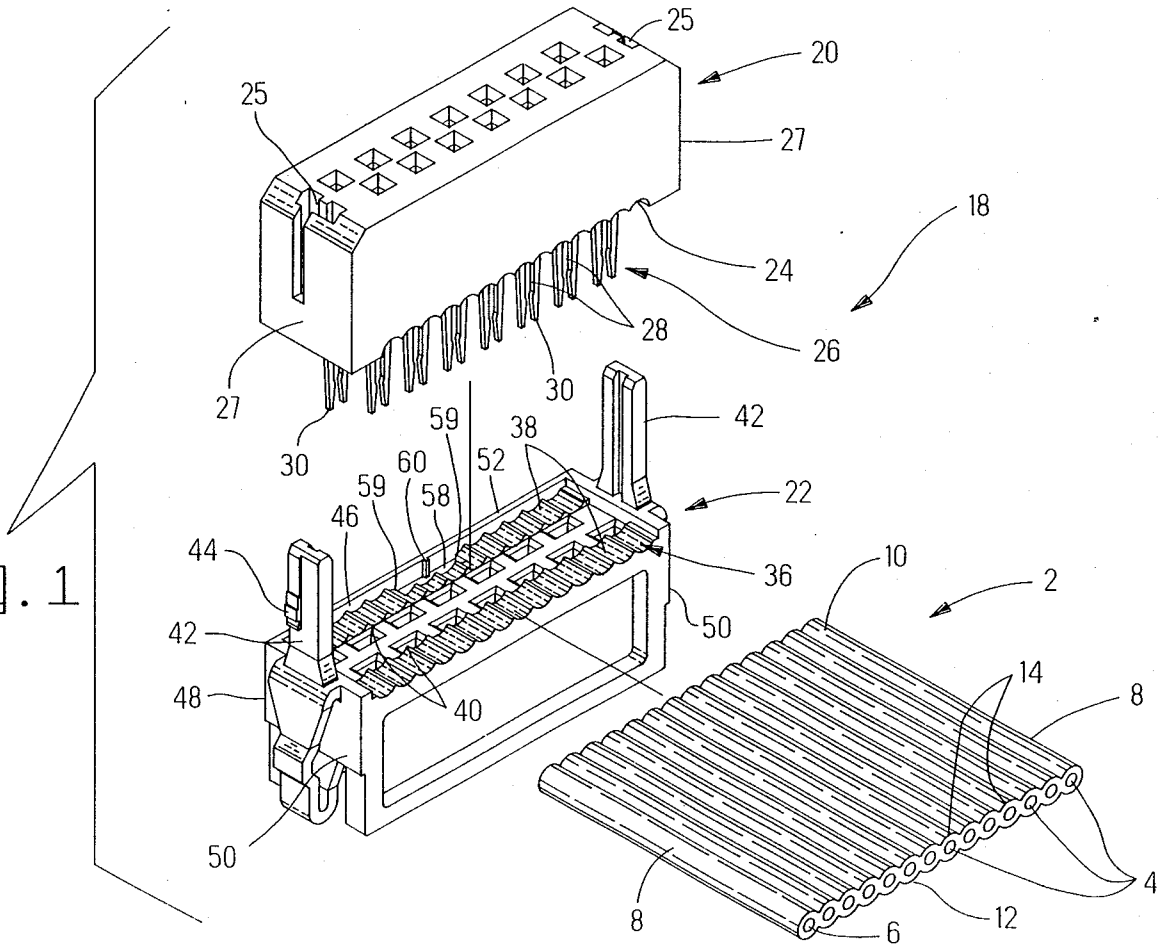
FIG. 1 is a perspective view of a connector of the invention showing the cover and housing spaced apart from each other, prior to a cable being inserted therebetween.

As shown in FIG. 1, a flat conductor cable 2 comprises a plurality of parallel side-by-side conductors 4 embedded in plastic material 6. Conductors 4 are coplanar and define a conductor plane. Cable 2 has parallel side edges 8, an upper major surface 10, and a lower major surface 12.

Upper and lower surfaces 10, 12 have, in transverse cross section, a series of cylindrical convex projections 14, each projection having a conductor 4 centrally located with respect thereto. Projections 14 on the two surfaces 10, 12 are opposed to, and in alignment with each other. The type of cable shown has a continuous thick mass insulating material between adjacent conductors rather that a thin membrane as with some known type of flat cable.

FIG. 1 shows a multi-contact connector 18 of a type which is installed on cable 2 to establish electrical contact with conductors 4 in cable 2. Connector 18 comprises a generally prismatic housing 20 and a cover 22. Housing 20 has a cable receiving face 24 which is directed downward in FIG. 1. Extending from face 24 are terminals 26 which are of the insulation displacement type. Openings 25 are provided proximate end walls 27 of connector 18, the openings extend from cable receiving face 24.

Terminals 26 are usually arranged in two or more parallel rows which extend between end walls 27 of connector 18. The spacing of terminals 26 is such that terminals 26 of one row are staggered with respect to terminals 26 in the other row. Terminals 26 have insulation piercing free ends 30 which are spaced from cable receiving face 24 and wire-receiving slots 28 which extend inwardly from free ends 30. Electrical contact is established between connector 18 and cable 2 by forcing a conductor 4 of cable 2 into a slot 28 of terminal 26 of connector 18, such that the opposed surfaces of each slot 28 contact a respective conductor 4.

Cover 22 has a surface 36 which is opposed to cable receiving surface 24 of housing 20. Surface 36 has side-by-side concave depressions 38 positioned therein. These concave depressions 38 have substantially the same radius of curvature as do convex cylindrical projections 14 of cable 2. Openings 40 extend through cover 22 so that free ends 30 of terminals 26 can be passed through these openings when connector 18 is installed on cable 2.

Latch arms 42 extend from surface 36 of cover 22, in a direction which is essentially perpendicular to the plane of surface 36. Resilient projections 44 are provided on latch arms at a position which is spaced from surface 36. The latch arms and resilient projections cooperate with opening 25 of housing 20 to insure that the latch arms and resilient projections maintain cover 22 in position relative to housing 20.

A stop wall 46 is provided on cover 22, so that as the cable 2 is inserted onto the cover, the stop wall provides a positive stop means for the cable. This insures that the cable will be properly positioned relative to the cover of the connector. Stop wall 46 is provided in essentially the same plane as a first side wall 48 of the connector (FIG. 1), and extends between end walls 50 of cover 22.

Figure 2:
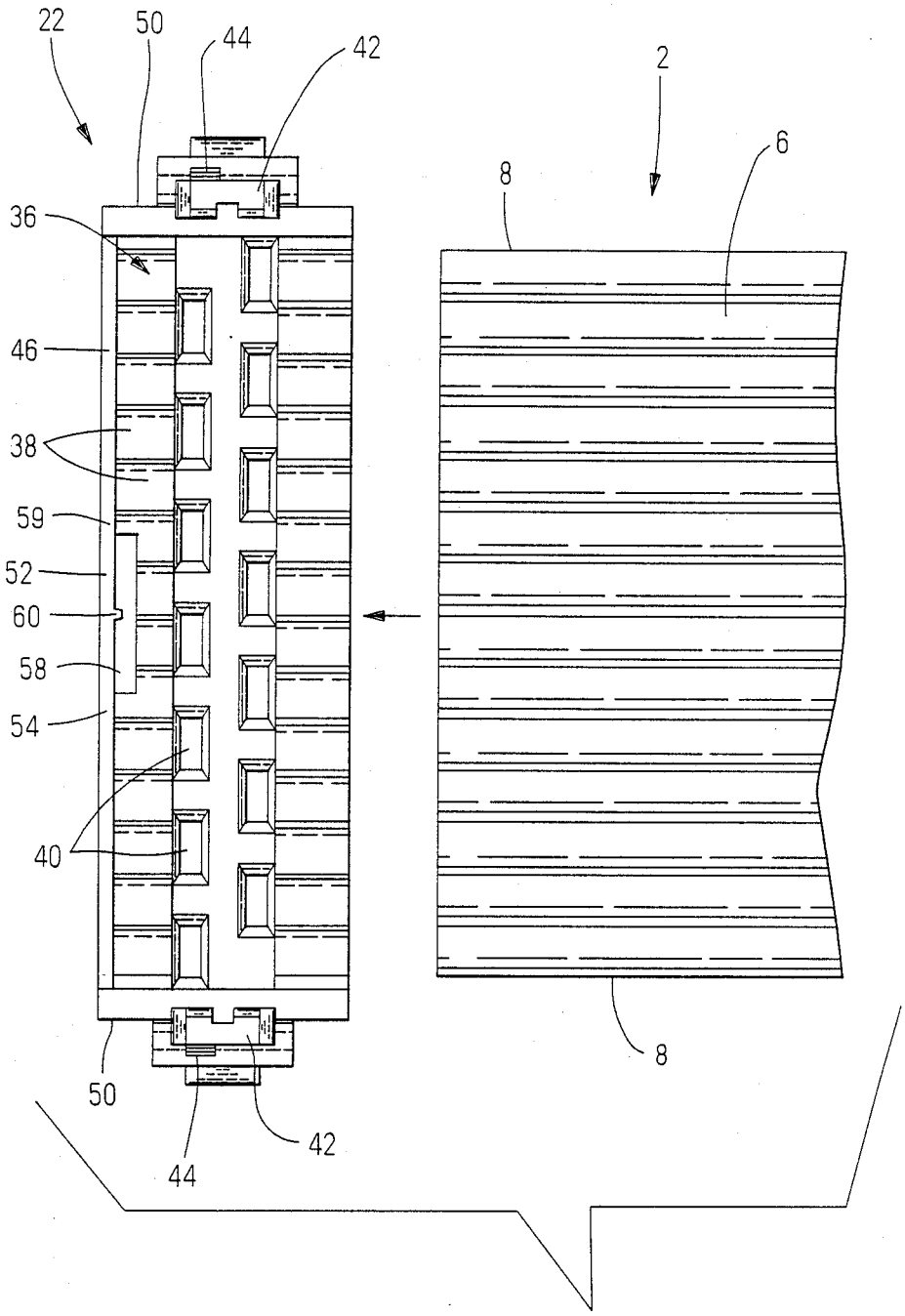
FIG. 2 is a top view of the cover of the connector showing the cable in a preinsertion position.
Figure 3:
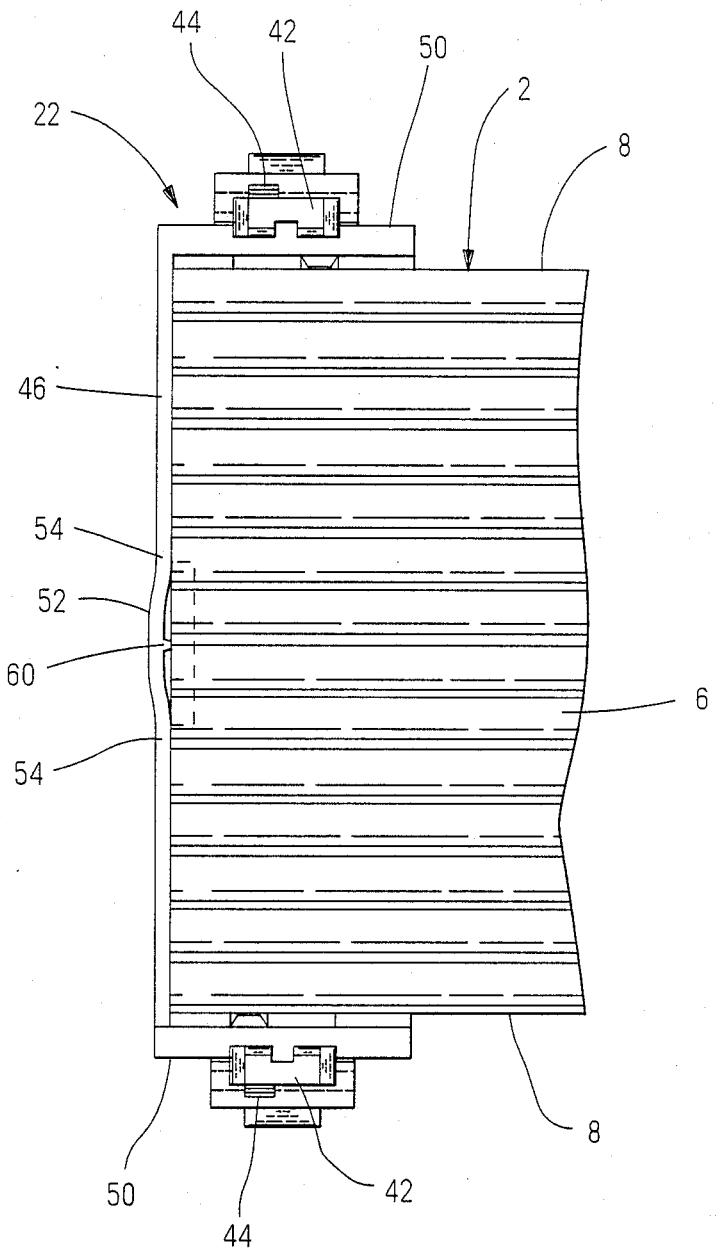
FIG. 3 is a top view of the cover of the connector, similar to that of FIG. 2, showing the cable fully inserted onto the cover, and just prior to the housing being moved into engagement with the cable and the cover.

As best shown in FIGS. 2 and 3, stop wall 46 has a weakened or movable resilient central portion 52. The resilient central portion 52 is integrally attached with stop wall 46 at the opposed ends 54 thereof. The side surfaces of portion 52 remain free to move with respect to side wall 46. This resilient nature of resilient central portion 52 is attributable to the material used in construction. It is important to note that the force required to deflect portion 52 is not great. As slot 58 is provided, only the ends 54 are attached to stop wall 46. Consequently, only minimal force is required to deflect portion 52.

A projection 60, or the like, is provided on the resilient central portion 52. The projection is provided to engage the cable as the cable is inserted into cover 22, thereby insuring that the resilient central portion will be displaced as the cable in inserted, causing a switch to be activated, as will be more fully discussed below.

In operation, cover 22 and housing 20 are positioned in applicator tooling. Cover 22 is generally positioned below housing 20 in order for the cable to be easily inserted into the tooling. The positioning of cover 22 and housing 20 are accurately controlled, so that as the applicator tooling terminates connector 18 onto cable 2, the connector cover 22 and housing 20 are precisely aligned It should be noted that covers 22 and housing 20 are preassembled before being positioned in the applicator tooling. In this preassembled or pretermination position, surfaces 24, 36 of housing 20 and cover 22, respectively, are spaced apart.

With cover 22 and housing 20 accurately positioned and maintained in the tooling in a pretermination position, cable 2 is brought to an initial or preinsertion position, as shown in FIG. 2. In this position, conductors 4 of cable 2 are provided in alignment with depressions 38 of surface 36 of cover 22. As was previously stated, cover 22 and housing 20 are spaced from each other prior to termination. Consequently, an opening is provided between the cover and the housing, between which the cable can be inserted.

Cable 2 is inserted into the opening which is provided between cover 22 and housing 20. The alignment of the cable relative to the cover is maintained by latch arms 42. Latch arms 42 are spaced apart a distance which is slightly greater than the width of the cable. Consequently, as the cable is inserted between the latch arms, the spacing insures that the cable will be maintained in alignment with the cover.

During the insertion of the cable into the opening, the cable is maintained proximate surface 36 of cover 22. In fact it is likely that during the insertion of the cable, the cable will slide across surface 36 of cover 22. This provides another alignment means as the cable is inserted. The concave depressions 38 cooperate with the convex projections 14 of the cable to insure that the cable is accurately maintained in position as the cable is inserted.

As the insertion of cable 2 continues, the end of cable 2 engages embossment 60 of resilient central portion 52. However, as only minimal force is required to deflect portion 52, the further movement of the cable toward stop wall 46 is not prevented. In other words, the insertion of the cable provides a sufficient force to bend portion 52.

The insertion of cable 2 is complete when the end of cable 2 engages stop wall 46, as shown in FIG. 3. In this fully inserted position, resilient central portion 52 is bowed outward,.away from the end of cable 2. This configuration is insured due to the cooperation of the end of cable 2 with embossment 60 as insertion of the cable occurs. As was previously stated, the engagement of cable 2 with stop wall 46 insures that the cable is accurately positioned relative to the cover.

In the prior art connectors, when the cable was fully inserted, the end of the cable would engage a switch or the like which would cause the applicator tooling to terminate the housing onto the cable and the cover. However, in the present invention, having the cable engage a switch is made impossible by the stop wall which acts to protect the ends of the cable. Consequently, a means must be provided to activate the applicator tooling when the cable is fully inserted on the cover.

The outward bending of portion 52 provides the means to activate the applicator tooling. When the central portion is bent, a proximity switch is activated, causing the applicator tooling to terminate the housing 20 and cover 22 onto the cable 2. It is important to note that the termination will not occur until the cable is properly positioned, because the cable must be provided in engagement with the stop wall in order for the central portion to be bent enough to engage the switch. Consequently, the proper alignment of the cable to the cover and housing is insured.

Utilizing the present invention requires that a proximity switch be added to the applicator tooling. As this is an easy and cost effective operation, the connector of the present invention is a practical solution to the problem.

The insertion of the cable causes the resilient center portion to bend outward, as was described. This outward configuration of resilient center portion causes the resilient center portion to activate the proximity switch, thereby causing the connector to electrically engage the cable. It should be noted that although the resilient center portion is bent outward to activate the applicator tooling, the bend is not great enough to cause any problems for the connector when the connector is installed on circuitry or the like.

The present invention has the advantage of covering the end of the cable, thereby preventing the cable from making electrical contact with any other outside source. Consequently, the connector of the present invention is more reliable than connectors of the prior art. Another advantage of the connector relates to the ease of adapting the applicator tooling.

Changes in the construction will occur to those skilled in the art and various apparently different modifications and embodiments may be made without departing from the scope of the invention. The matter set forth in the foregoing description and accompanying drawings is offered by way of illustration only.

I claim:

1. An electrical connector having a mating surface and a termination surface, the termination surface cooperating with a ribbon cable, end walls and side walls of the connector extend from the mating surface to the termination surface, the electrical connector being characterized in that:

a first side wall extends beyond the termination surface, away from the mating surface, to provide a stop surface with which the ribbon cable cooperates to insure that the ribbon cable is provided in accurate alignment with the electrical connector, a movable portion is provided on the portion of the first side wall which extends beyond the termination surface, the movable portion being movable with respect to the stop surface.

2. An electrical connector as set forth in claim 1 characterized in that the movable portion has a projection provided thereon, the projection extends from the first side wall toward a second side wall, the projection cooperates with the ribbon cable as the ribbon cable is advanced toward the first end wall, such that as an end of the cable is positioned against the stop surface, the movable portion is caused to move away from the second side wall.

3. An electrical connector as set forth in claim 1 characterized in that the movable portion is resiliently attached to the stop surface, such that the movable portion will be movable between a first or unstressed position and a second or stressed position.

4. An electrical connector as set forth in claim 1 characterized in that the movable portion has a generally rectangular configuration, ends of the movable portion are integrally attached to first side wall of the connector.

5. An electrical connector as set forth in claim 4 characterized in that a slot is provided in the first side wall of the connector proximate the movable portion, the slot providing a separation between the movable portion and the first side wall, thereby allowing the movable portion to move easily with respect to the stop surface of the first side wall.

* * * * *